United States Patent [19]

Rogers

[11] 4,350,258

[45] Sep. 21, 1982

[54] TANK-BAFFLE SYSTEM

[75] Inventor: R. Barry Rogers, London, Canada

[73] Assignee: White-McKee Inc., Elmira, Canada

[21] Appl. No.: 195,109

[22] Filed: Oct. 8, 1980

[30] Foreign Application Priority Data

Jul. 30, 1980 [CA] Canada ..... 357329

[51] Int. Cl.[3] ..... B65D 25/04

[52] U.S. Cl. ..... 220/22; 220/80

[58] Field of Search ..... 220/22, 80

[56] References Cited

U.S. PATENT DOCUMENTS

| | | | |
|---|---|---|---|
| 1,040,401 | 10/1912 | Perry | 220/22 |
| 1,562,074 | 11/1925 | Baum | 220/22 |
| 1,616,008 | 2/1927 | Stout | 220/22 |
| 2,124,441 | 7/1938 | Thwaits | 220/80 |
| 2,134,678 | 10/1938 | Bellig | 220/22 |
| 2,861,708 | 11/1958 | Sasserson | 220/22 |
| 2,889,018 | 6/1959 | Swan | 220/22 |
| 2,947,440 | 8/1960 | Slota | 220/22 |

FOREIGN PATENT DOCUMENTS

| | | | |
|---|---|---|---|
| 323106 | 12/1929 | United Kingdom | 220/22 |

*Primary Examiner*—George E. Lowrance

*Attorney, Agent, or Firm*—LeBlanc, Nolan, Shur & Nies

[57] ABSTRACT

The invention is a tank-baffle system including a baffle member mounted in a tank and connected to the tank with a male-female interlocking arrangement thus avoiding the use of welding, adhesive or bolts. The invention is especially suitable for use in polyethylene tanks.

4 Claims, 4 Drawing Figures

TANK-BAFFLE SYSTEM

BACKGROUND OF THE INVENTION

This invention relates to a tank baffle system and method of mounting same.

Tanks are used to carry liquids from one place to another either over long distances for example by track, or short distances for example by a carrying apparatus in a factory. Tanks are also used in agriculture to carry liquid pesticides, herbicides or fertilizers. In such tanks there is often a need to mount baffles to prevent or suppress an undesirable wave motion of the liquid in the tank. Such movement can result in instability of the vehicle carrying the tank and also creates unnecessary pressure against the ends of the tank especially when the tank is large and partially filled and where the movement of the tank is irregular.

In the past, tanks made of glass fibre or metal can easily include baffles affixed to the tank by adhesive or bolts. However tanks may now be constructed of polyethylene and this material cannot be easily bolted. The pressures applied to a baffle within a tank may tear the bolt connection holding the baffle to the tank wall. Also polyethylene is not easily glued or welded. This may be especially true where the tank is to contain liquid chemicals which may attack the adhesive. Welding also weakens the polyethylene making it susceptible to cracking. The present invention teaches a baffle system which avoids the use of welding, bolting or gluing the polyethylene material.

SUMMARY OF THE INVENTION

According to one embodiment the invention is a tank-baffle system comprising a baffle member mounted in a tank and connected to the tank in a male-female interlocking arrangement.

According to a second embodiment the invention is a tank-baffle system comprising a baffle member mounted transversely in a tank with a tank wall including a groove on its inner wall surface so as to support the said baffle member.

According to a third embodiment the invention is a tank-baffle system comprising a baffle member mounted transversely in a tank with a tank wall including an inwardly projecting portion on its inner wall surface and a channel portion at the edges of said baffle member adapted to receive the said inwardly projecting portions.

BRIEF DESCRIPTION OF THE DRAWINGS

For the purpose of illustration but not of limitation three embodiments of the invention will be hereinafter described with reference to the attached drawings, in which.

DESCRIPTION OF THE PREFERRED EMBODIMENTS

Figures 1, 2:
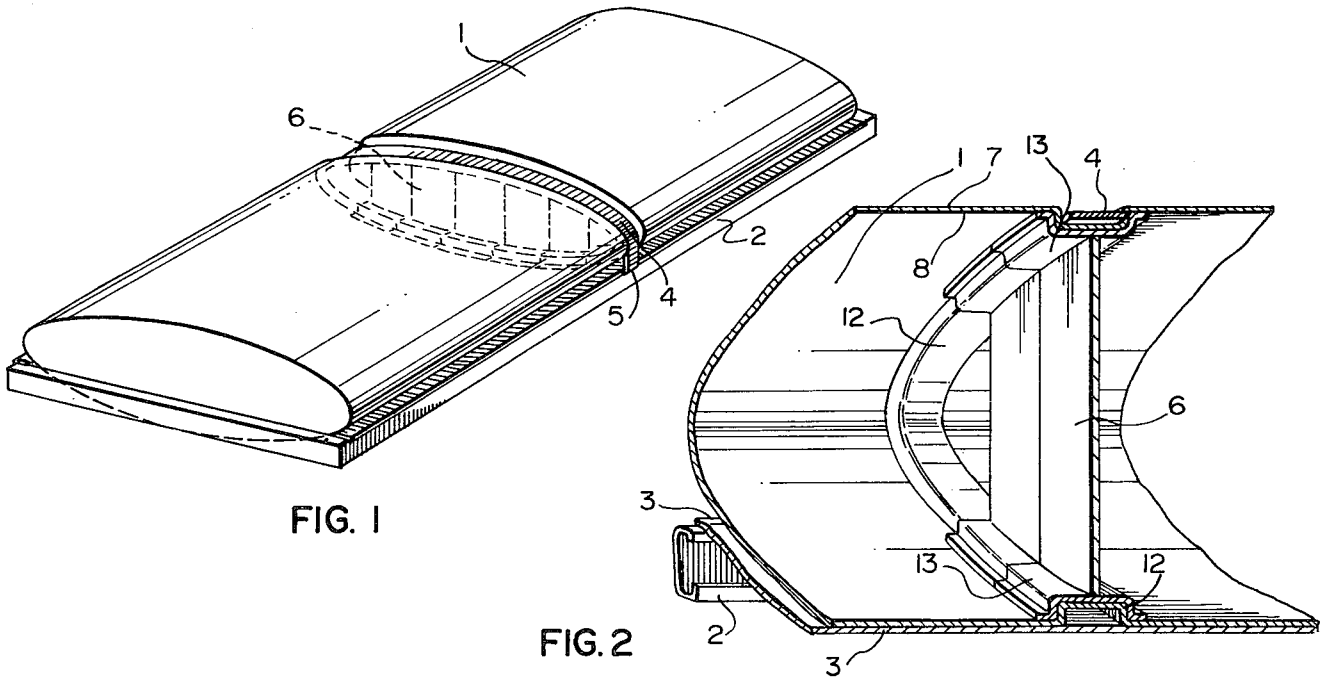
FIG. 1 shows a tank mounted on a supporting vehicle.
FIG. 2 shows a cross-section along line 2—2 of FIG. 1.

In FIG. 1 a tank 1 is supported on a carrying vehicle a part of which is shown at 2 and with a saddle 3 on which the tank 1 rests. The tank may be held in place by a strapping means which could comprise a web or cable which encircles the top of the tank and may be attached for example at 5 to the carrying vehicle 2. Alternatively or in addition the strapping means may encircle the tank to provide increased rigidity.

Figure 4:
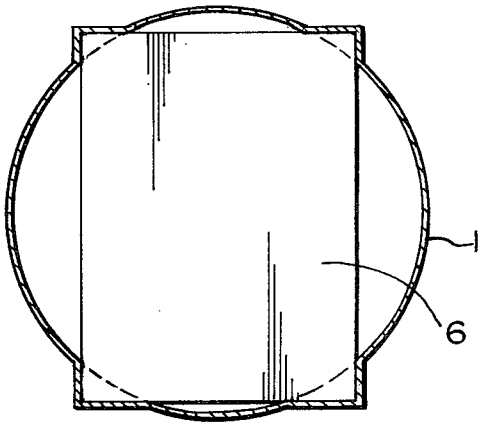
FIG. 4 shows a third embodiment of the invention.
Figure 3:
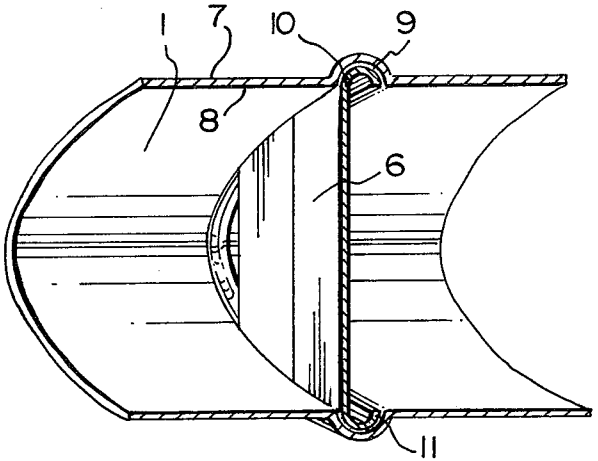
FIG. 3 shows a second embodiment of the invention.

Three embodiments of the invention are shown in FIGS. 2, 3 and 4. FIG. 2 shows an inwardly projecting portion 12 forming a ridge along the interior surface 8 of the tank 1. In the embodiment shown the wall of the tank 1 has been indented so as to form the inwardly projecting portion which is rib-like in shape. Alternatively the inwardly projecting portion could merely comprise a thickened ridge portion without creating any discontinuity on the exterior surface 7 of the tank. In either case this ridge portion has an advantage of providing increased strength to the tank. The primary purpose of the inwardly projecting portion 12 is, however, to provide a "male" projection which can be surrounded by a channel portion 13 which is affixed to or created integrally with each baffle 6 which extends transversely in the tank. By transversely is meant across, not necessarily at right angle. The dimensions of the inwardly projecting portion 12 and the channel portion 13 are such so as to allow a male-female interlocking arrangement. Furthermore the dimensions are such that when the liquid carried in the tank exerts pressure on baffle 6 which may, in turn, experience some degree of flexure, the male-female interlocking arrangement between the inwardly projecting portion 12 and the channel portion 13 does not separate. Of course the baffles 6 may be of such dimensions as to resist flexure and may themselves include reinforcing ribs to resist excessive flexure. Of course there may be a pair of inwardly projecting portions, the baffle being held therebetween, in which case the baffle would not include the channel portion 13.

The primary purpose of the baffles is to prevent undesirable movement of the liquid in the tank. A secondary advantage of the baffles is that they will provide some structural support to the tank, especially where the tank is made of a polyethylene.

In the embodiment shown in FIG. 2 a strapping means 4 may be located in the indentation formed in the outer surface 7 of the tank 1 when the inwardly projecting portion is formed. This strapping means 4 could comprise a web of steel or other material, as shown and, as indicated above, may be used to hold the tank on the carrying vehicle 2. In addition the strapping means 4 assists in providing structural rigidity to the tank by tending to hold the vertical dimension of the tank constant and thereby also assists in maintaining the male-female interlocking arrangement between the inwardly projecting portion 12 and the channel portion 13. The strapping means could also comprise a cable of circular cross-section in which case the inwardly projecting portion and the corresponding channel portion could be of similar cross-sectional shape. Of course other methods could be used to affix the tank to the carrying vehicle.

In FIG. 3 the inside surface 8 of the tank 1 includes a groove 9 extending transversely across the tank. This groove 9 could be formed in the tank wall as an indented portion of the wall as shown in FIG. 3 whereby the exterior surface of the tank wall is correspondingly interrupted. Alternatively a groove can be formed in the interior surface of the wall if it has sufficient thickness to accommodate such a groove without interruption of the outer surface.

In this embodiment baffle 6 may include a strengthening means 11 located at edge 10 of the baffle 6. The strengthening means 11 could be of any suitable cross-sectional shape but it is desirable that the shape be such as to accommodate the shape of the groove 9 so as to provide a good male-female interlocking arrangement. In this embodiment the male-female interlocking arrangement is opposite to that embodiment shown in FIG. 2 but in other respects is essentially the same. In this embodiment of the invention, suitable strapping means may also be applied to hold the tank 1 to the carrying vehicle 2.

FIG. 4 shows a third embodiment of the invention and is somewhat similar to that shown in FIG. 3. The baffle 6 is rectangular in shape while the tank 1 is substantially circular. Of course both the tank and the baffle could be of other suitable shapes. In this embodiment the groove is formed in the tank wall at the corners of the baffle while the corners of the baffle project into these grooves so as to form the male-female interlocking arrangement.

The baffle member may comprise a panel with a pad member at each end. The pad member would be similar to the web portion of channel member 13 and would be adapted to lie against the inner surface 8 of the tank. The surface of each pad member would be profiled or roughened in order to increase its coefficient of friction so as to firmly hold the baffle in place. The multiplicity of projections and indentations in this surface would press slightly into the inner surface 8 of the tank and thus comprises a plurality of male-female interconnecting relationships. This embodiment is particularly suited for tanks which are circular in cross-section.

Other geometric shapes of the baffle and tank and the connections therebetween as well as related modifications are within the scope of the present invention. For example passageways could be formed through the baffle system at the bottom of the tank so as to allow small amounts of liquid remaining in the tank to move between the sections of the tank separated by the baffles. In addition a single baffle or a series of baffles could be used at any dividing section, as shown in FIG. 2. A tank may include more than one of these baffle arrangements and the baffles need not necessarily be oriented orthogonally to the longitudinally dimension of the tank.

What I claim as my invention is:

1. A tank baffle system comprising: a tank, the outer wall of which is constructed of a plastic material, said wall having a portion which defines inwardly indented elongate channel portions on at least the top and the bottom outer surface of the tank with inwardly extending projection portions on the inner surface of the tank complementing and corresponding to said channel portions on the outer surface; a baffle member having a generally planar center portion and an elongate interlocking portion of generally U-shaped cross-section attached to and extending along at least the top and bottom ends of the planar center portion, said planar center portion being substantially aligned with the vertical axis of said U-shaped portions, said U-shaped portions receiving portions of the inwardly extending projection portions on the inner surface of the tank to provide a male-female interlocking arrangement; and a strap received in at least a part of the inwardly indented channel portions on the tank outer surface to provide structural rigidity and for use in mounting said tank on a carrying vehicle or other mounting location.

2. The tank baffle system of claim 1 wherein said inwardly indented channel portions on the tank outer surface and corresponding inwardly extending projection portions on the tank inner surface extend around the entire circumference of the tank.

3. The tank baffle system of claim 1 wherein said inwardly extending projection portions on the inner surface of the tank are rib-like in shape.

4. The tank baffle system of claim 1 wherein said tank outer wall is made of polyethylene.

* * * * *